US006070922A

United States Patent [19]

Gross

[11] Patent Number: 6,070,922

[45] Date of Patent: Jun. 6, 2000

[54] SHOWER DOORS LOCKING DEVICE

[76] Inventor: David Gross, 2-12 W. Park Ave., Long Beach, N.Y. 11561

[21] Appl. No.: 09/389,609

[22] Filed: Sep. 3, 1999

[51] Int. Cl.[7] ..... E05C 19/18

[52] U.S. Cl. ..... 292/289; 292/288; 292/259 R

[58] Field of Search ..... 292/289, 288, 292/259 R, 342

[56] References Cited

U.S. PATENT DOCUMENTS

| | | | |
|---|---|---|---|
| 2,873,769 | 2/1959 | Turt et al. | 292/288 |
| 3,347,585 | 10/1967 | Chmura | 292/294 |
| 3,622,190 | 11/1971 | Mohun | 292/288 |
| 3,938,839 | 2/1976 | Collier | 292/258 |
| 4,330,146 | 5/1982 | Sessions, Jr. | 292/258 |
| 4,993,761 | 2/1991 | Paskert | 292/288 |
| 5,125,699 | 6/1992 | Dinan | 292/288 |
| 5,386,664 | 2/1995 | Lumenello | 49/404 |
| 5,480,200 | 1/1996 | Aintablian | 292/288 |

*Primary Examiner*—B. Dayoan
*Assistant Examiner*—John B. Walsh
*Attorney, Agent, or Firm*—Myron Amer P.C.

[57] ABSTRACT

For sliding doors of a stall shower tracking in front and rear tracks with a sliding clearance therebetween, front and rear brackets suspended on the tracks and each having a leg respectively projected into a tracking path of movement, and each having additional legs positioned in the sliding clearance for interconnection to thereby immobilize the doors against sliding movement while the brackets remain interengaged thus serving, as one end use, the child-proofing of the stall shower against any non-supervised entry into the stall shower when it is not in use.

1 Claim, 2 Drawing Sheets

SHOWER DOORS LOCKING DEVICE

FIELD OF THE INVENTION

The present invention relates generally to improvements for a stall shower of a type in which opening sliding movement of either one of two doors provides access into the showering area, the improvements more particularly relating to a locking attachment readily applied to the closed doors primarily to child-proof the shower to prevent an inquisitive toddler from making an unsupervised entry into the showering area, when the shower is not in use.

EXAMPLES OF THE PRIOR ART

It is known by common experience that openings into a stall shower or from a dwelling onto a patio require the use usually of two sliding doors to accommodate the widthwise expanse of the opening. Patio doors may have provision on one sliding door of a lock mechanism on the front edge thereof which cooperates with a lock mechanism on the sill of the door opening to control the opening of the door. This operating mode is exemplified by U.S. Pat. No. 3,640,559 for "Security Device For Sliding Windows And Doors" issued to James M. Royer on Feb. 8, 1972.

A slightly varied approach is to affix, by a threadably actuated clamp or similar sliding motion-obstructing stop, in the path of movement of a selected one of the two doors, as exemplified by the threadably applied stop 19 of U.S. Pat. No. 3,975,041 for "Sliding Panel Lock" issued to Timothy Edison on Aug. 17, 1976, and also exemplified by the threadably applied stop 24 of U.S. Pat. No. 4,304,429 for "Locking Apparatus For Sliding Windows And The Like" issued to Marion A Gist on Dec. 3, 1981, to mention but a few.

Although having some utility for the purposes intended, the noted and all other known sliding door locking devices are affixed to a selected sliding door track to function as a stop in that selected door track, thus often permitting a degree of sliding opening movement in the other door, although the door not selected may not have a hand grip to facilitate urging the door in sliding movement or be accessible for outdoor patio use. Sliding of the other door is made inconvenient, but is not entirely eliminated.

The affixing, by threadable engagement or by a similar connecting technique, of a motion-obstructing stop in a track is, as should be readily appreciated, not as desirable as a non-affixed movement-controlling means which is more readily applied, when needed, by being merely suspended on the upper tracking structure of the doors, all as will be better understood as the description proceeds.

SUMMARY OF THE INVENTION

Broadly, it is an object of the present invention to provide stall shower sliding doors with a sliding movement control overcoming the foregoing and other shortcomings of the prior art.

More particularly it is an object to provide interengaged brackets suspended on the shower overhead track means and merely positioned in the defined paths of movement of the two sliding doors' tracks, but not affixed in any way to those tracks, which prevents opening movement of either of the two doors unless the brackets are disengaged.

Underlying the present invention is the recognition that an immobilized "first" door can serve as a stop or the like preventing sliding movement of the "second" door, and vice versa, and thus for the purposes intended achieving door movement control, but without any physically affixed movement-blocking stops in either of the door tracks.

The description of the invention which follows, together with the accompanying drawings should not be construed as limiting the invention to the example shown and described, because those skilled in the art to which this invention appertains will be able to devise other forms thereof within the ambit of the appended claims.

DETAILED DESCRIPTION OF THE INVENTION

Figure 1:
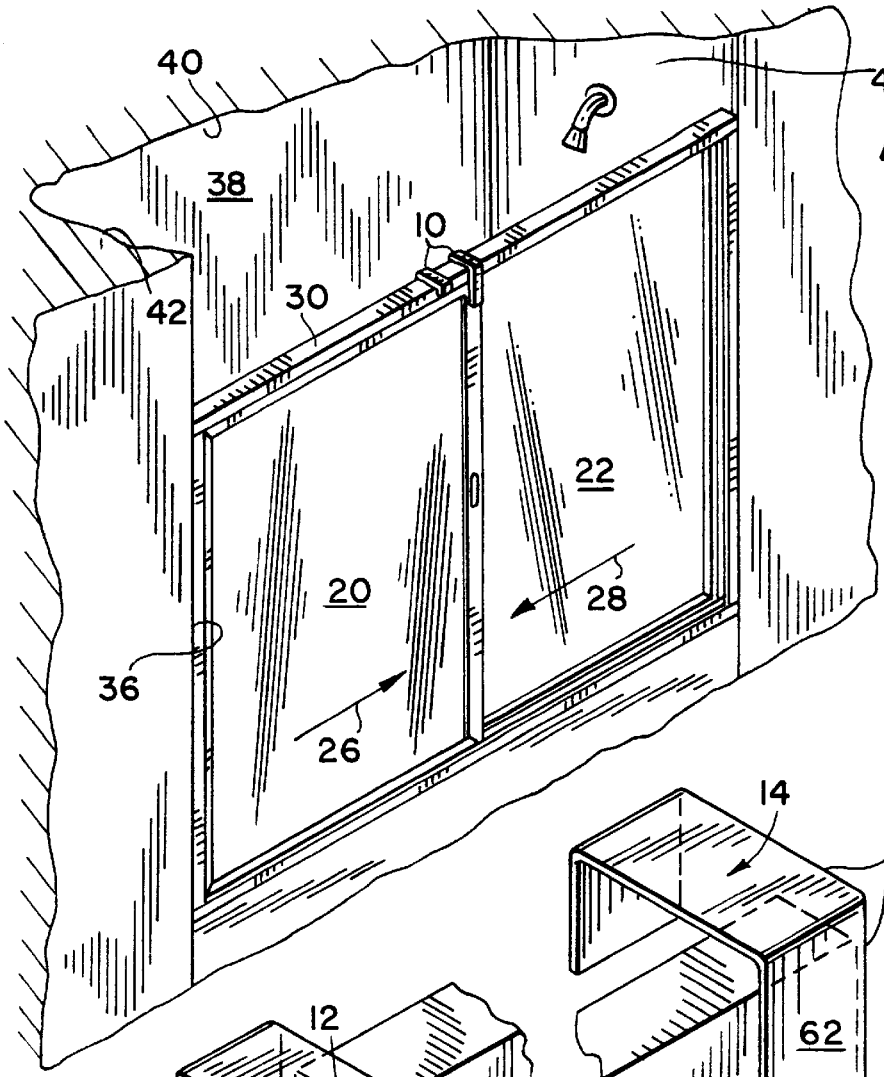
FIG. 1 is a perspective view of a so-called stall shower with sliding front and rear doors held closed by shower doors locking device according to the present invention.
Figure 2:
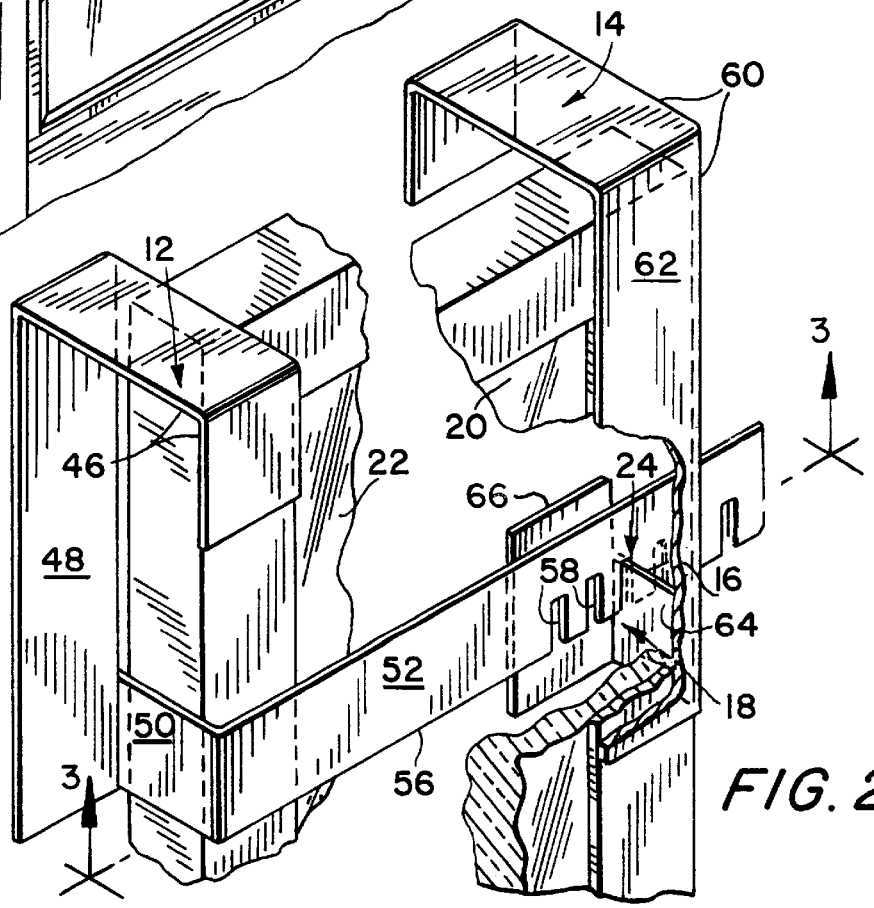
FIG. 2 is a partial perspective view on an enlarged scale of the shower doors locking device.
Figure 3:
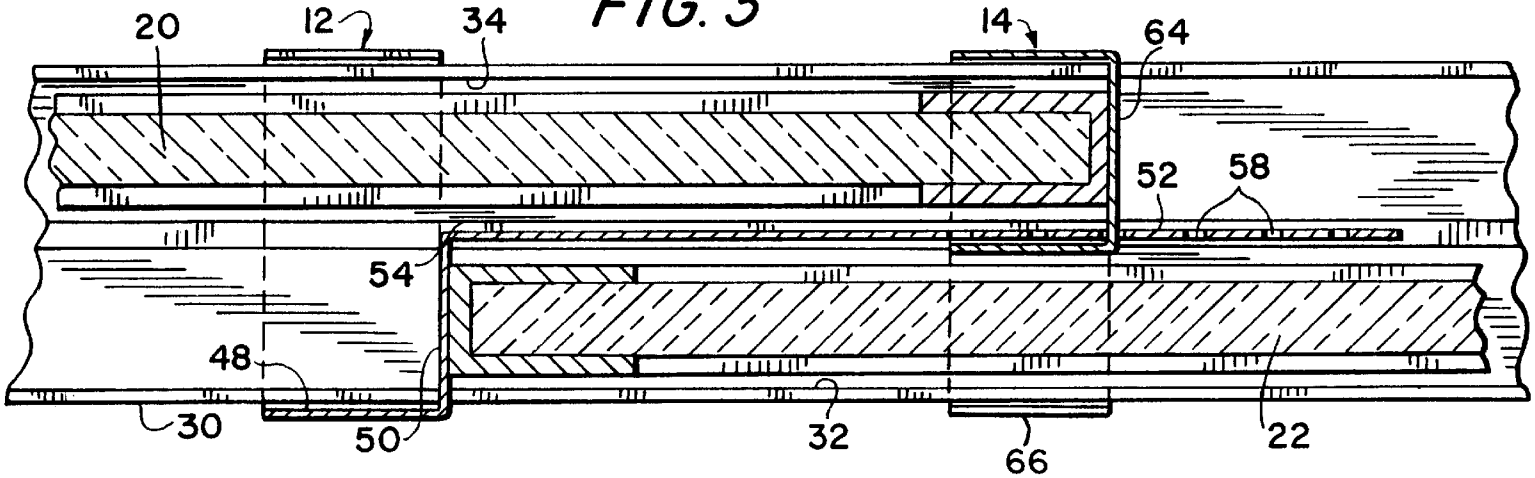
FIG. 3 is a sectional view taken along line 3—3 of FIG. 2 and in the direction of the arrows in which the position of the doors as viewed is reversed than as viewed in FIG. 2.
Figure 5:
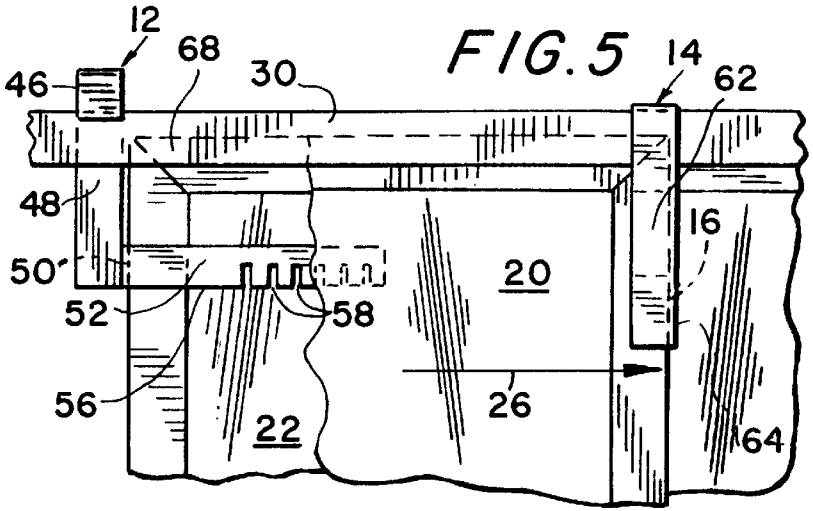
FIG. 5 is another partial front elevational view.
Figure 4:
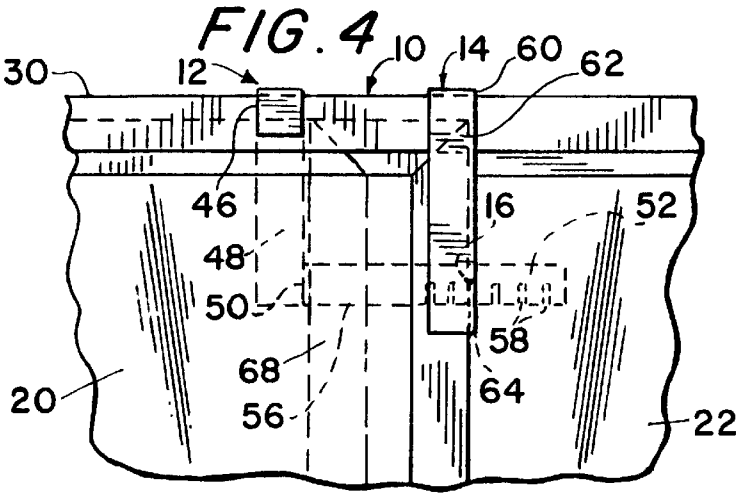
FIG. 4 is a partial front elevational view.

As will be better understood as the description proceeds, a shower doors locking device, generally designated 10, contemplates the use of two cooperating brackets 12 and 14, one with an edge 16 (bracket 14) and the other with a series of edge-receiving slots, individually and collectively designated 18, which, applied to closed front and rear doors 20 and 22 as best shown in FIG. 1, will interconnect, as at 24 (FIG. 2) and, as a consequence prevent the brackets 12 and 14 from being separated from each other, which in turn prevents front door 20 and rear door 22 also from being separated from each other in door-opening directions 26 and 28.

The doors 20 and 22 are slidably disposed in an overhead track construction 30 having a rear track 32 and a front track 34 and said doors serve as a closure for a front opening 36 into a showering area 38 bounded by a rear wall 40 and opposite side walls 42 and 44. Typically, doors 20, 22 are not provided with a locking bolt mechanism and thus to prevent unsupervised entry by toddlers into the showering area 38, the shower doors locking device 10 serves this end purpose.

To this end, bracket 12 has an inverted U-shaped upper end 46 disposed rearwardly over the track construction 30 such that a first rear leg 48 is in depending relation behind the rear door 22, a second perpendicularly oriented leg 50 projected into the path of movement 28 of the rear door 22 tracking in rear track 32 and a third leg 52 oriented perpendicularly of the second leg 50 which is inserted into the sliding clearance 54 between the doors 20, 22. In a lower edge 56 of leg 52 are a series of sites of attachment in the form of slots, individually and collectively designated 58, the significance of which will soon be apparent.

Cooperating with bracket 12 is bracket 14 having an inverted U-shaped upper end 60 disposed forwardly over the track construction 30 such that a first front leg 62 is in depending relation in front of the front door 20, a second perpendicularly oriented leg 64 projected into the path of movement 26 of the front door 20 tracking in front track 34 and connected to an inboard leg 66 also disposed in the running clearance 54 to assist in maintaining the interengagement of the brackets 12 and 14.

When edge 16 is seated in a selected slot 58, the brackets 12 and 14 are held against movements 26 and 28. Preferably, from a slightly raised position a bracket 12 selected slot 58 is lowered over the edge 16 positioned in its descending path of movement. As a consequence, the doors 20 and 22 supporting the brackets 12 and 14 cannot be separated and/or moved in open positions by the typical strength of a toddler, and thus the showering area 38 is child-proofed.

For completeness' sake, it is noted that to protect against damage the peripheral edges of the doors 20, 22 because of their fragile glass construction material, these edges are trimmed or framed in thin gauge metal attachments 68, shown in phantom perspective in the drawings.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defmed in the appended claims.

What is claimed is:

1. A shower doors locking device comprising a rear wall with spaced apart opposite side walls extending laterally therefrom bounding a showering area, adjacent front and rear tracks mounted in spanning relation between said side walls and in a clearance position forward of said rear wall, front and rear shower doors adapted to partake of sliding movement in a cooperating said front and rear track along paths of movement with a sliding clearance therebetween, and for attachment to said front and rear shower doors a first bracket mounted on a track so as to position a depending first leg behind said rear door, a first bracket second leg extending into said path of movement of said rear door, a first bracket third leg extending transversely into said sliding clearance having slots for interengagement thereon, a second bracket mounted on a track so as to position a depending first leg forward of said front door, a second bracket second leg extending into said path of movement of said front door, a second bracket third leg having a slot-penetrating interengagement edge thereon, operative positions of movement of said front and rear doors closing off access to said showering area and in contact respectively with said bracket second legs in said paths of movement thereof, and interengagement of a selected one said slot with said slot-penetrating edge to immobilize said shower doors against opening sliding movement, whereby access by a child into said showering area without adult assistance is obviated.

* * * * *